US005403372A

United States Patent [19]

Uchida

[11] Patent Number: 5,403,372

[45] Date of Patent: Apr. 4, 1995

[54] VANE MATERIAL, VANE, AND METHOD OF PRODUCING VANE

[75] Inventor: Norimasa Uchida, Yonago, Japan

[73] Assignee: Hitachi Metals, Ltd., Tokyo, Japan

[21] Appl. No.: 900,285

[22] Filed: Jun. 18, 1992

[30] Foreign Application Priority Data

Jun. 28, 1991 [JP] Japan ..... 3-158159

[51] Int. Cl.[6] ..... C22C 29/02; B22F 3/14

[52] U.S. Cl. ..... 75/236; 75/239; 75/240; 75/243; 75/246; 419/11; 419/14; 419/28; 419/49

[58] Field of Search ..... 75/238, 240, 243, 246, 75/239, 236; 419/14, 15, 18, 66, 11, 49, 28

[56] References Cited

U.S. PATENT DOCUMENTS 4,964,908 10/1990 Greetham ..... 75/241
5,035,579 7/1991 Yada et al. ..... 416/241 R
5,125,811 6/1992 Amano et al. ..... 418/179

FOREIGN PATENT DOCUMENTS 56-47550 4/1981 Japan .
59-20446 2/1984 Japan .
61-48556 3/1986 Japan ..... 1/
135091 2/1989 Japan .
2102392 4/1989 Japan .
4165052 6/1992 Japan .

*Primary Examiner*—Ngoclan T. Mai
*Attorney, Agent, or Firm*—Sughrue, Mion, Zinn, Macpeak & Seas

[57] ABSTRACT

Vane material, vane and method of producing a vane to be used in a compressor using a substitute freon, improving the wear resistance thereof. The vane material has a composition consisting of by weight: 1.0–2.5% of C; not more than 1.5% of Si; not more than 1.0% of Mn; 3–6% of Cr; one or two of not more than 20% W and not more than 12% Mo where "W+2Mo" being 15–28%; 3.5–10% of one or two of V and Nb; and the balance of Fe and incidental impurities. Carbides are uniformly dispersed in the matrix thereof where their average diameter does not exceed 1.5 μm and the maximum diameter thereof does not exceed 6 μm. A method of producing a vane is also disclosed, in which an atomized powder having the composition as described is compacted and it is then subjected to hot working, or to hot working and cold working.

13 Claims, 1 Drawing Sheet

VANE MATERIAL, VANE, AND METHOD OF PRODUCING VANE

BACKGROUND OF THE INVENTION

The present invention relates to a vane of a compressor to be used, for example, in a rotary compressor or a vane pump.

FIG. 1 shows an example of a known compressor with a vane. A vane 1 is continuously pressed against a rotor 2 by means of a helical compression coil spring 4, so that a gas in the space formed between the rotor 2 and a cylinder 3 is compressed by change in volume thereof due to the eccentric rotation of the rotor 2. A freon gas is conventionally used as the gas acting as the cooling medium.

The terminal end of the vane and the side surfaces of the vane are continuously in sliding-contact with the rotor and the cylinder, respectively. Thus, the required characteristics of a vane is not only that the vane itself does not wear but also that it does not cause wearing of the mating rotor and cylinder. Conventional vanes are produced from high speed steels equivalent to JIS SKH51 by melting and casting processes. In some cases, the thus produced vanes are surface-treated with oxynitriding. Further, proposals have been made with respect to modification in the composition of the material for a vane, improvement in wear resistance and improvement in self-lubricating ability as disclosed in JP-A-56-47550, JP-A-59-20446, JP-A-61-48556, JP-A-64-35091 and JP-A-2-102392.

A freon of the chlorofluorocarbon (hereinafter referred to as CFC) type is used as the cooling medium in the above described compressors. CFC, however, is decomposed by ultraviolet radiation after its diffusion into the stratosphere where it emits chlorine which destroys the ozone layer. For this reason, it is now planned to totally ban CFC by the year 2000, and development of a cooling medium is in progress to replace this. A freon of the hydrofluorocarbon (hereinafter referred to as HFC) type which does not contain chlorine seems to be most promising as the substitute cooling medium. This type of freon is less harmful to the environment.

However, when compared to those using a conventional CFC type freon, a vane pump or rotary compressor using a HFC type freon has the following disadvantages.

(1) Lubricating ability of the cooling medium is inferior.
(2) A higher compression ratio is required, whereby the load to be applied to vane becomes higher.
(3) Hygroscopicity of the cooling medium is high.
(4) Lubricating ability of the lubricant oil is inferior.
(5) Hygroscopicity of the lubricant oil becomes higher.

For the reasons as described above, in the case where a conventional vane is used, the wear resulting from sliding-contact with the rotor is greatly accelerated and, in extreme cases, scatting may be caused with the sliding-contact. It is thus increasingly apparent that lifetime as a practical compressor cannot be obtained.

SUMMARY OF THE INVENTION

Thus, an object of the present invention is to provide a novel vane material, vane and method of producing a vane which may be used in a compressor using a HFC-type freon as the cooling medium.

According to a first aspect of the present invention, a vane material is provided, which contains by weight: 1.0–2.5% of C (carbon), not more than 1.5% of Si, not more than 1.0% of Mn, 3–6% of Cr, one or two selected from W and Mo in amount of not more than 20% of W and not more than 12% of Mo where "W+2Mo" is limited to 15–28%, 3.5–10% of one or two selected from V and Nb, and the balance of Fe and incidental impurities.

According to a second aspect of the present invention, a vane material is provided, which contains by weight: 1.0–2.5% of C, not more than 1.5% of Si, not more than 1.0% of Mn, 3–6% of Cr, one or two selected from W and Mo in amount of not more than 20% of W and not more than 12% of Mo where "W+2Mo" is limited to 15–28%, 3.5–10% of one or two selected from V and Nb, 1–15% of one or two selected from Co and Ni, and the balance of Fe and incidental impurities.

According to a third aspect of the present invention which limits each of the elements to their most desirable range, a vane material is provided, which contains by weight: 2.0–2.5% of C, 0.1–0.6% of Si, 0.1–0.6% of Mn, 3–6% of Cr, one or two selected from W and Mo in amount of not more than 20% of W and not more than 12% of Mo where "W+2Mo" is limited to 17–26%, 6–10% of one or two selected from V and Nb; 7–12% of one or two selected from Co and Ni, and the balance of Fe and incidental impurities.

According to a fourth aspect of the present invention, a vane material according to any one of the first through the third aspects of the present invention is provided, which has 15% or more in the area ratio of MC carbides, in which M is a symbol of a metal element(s) and C is a symbol of carbon, dispersed in the matrix.

According to a fifth aspect of the present invention, a vane is provided, which has the composition as disclosed in any one of the first through the fourth aspects of the present invention.

According to a sixth aspect of the present invention, a vane according to any one of the first through the fourth aspects of the present invention is provided, of which the vane surface is subjected to a hardening treatment.

According to a seventh aspect of the present invention, a vane according to any one of the first through the fourth aspects of the present invention is provided, of which the vane surface is coated with a hard coating.

According to an eighth aspect of the present invention, a method of producing a vane having substantially no pores is provided, in which an atomized powder having the composition disclosed in any one of the first through the fourth aspects of the present invention is compacted and it is then subjected to hot working, or to hot working and subsequent cold working.

DESCRIPTION OF THE PREFERRED EMBODIMENTS

Figure 1:
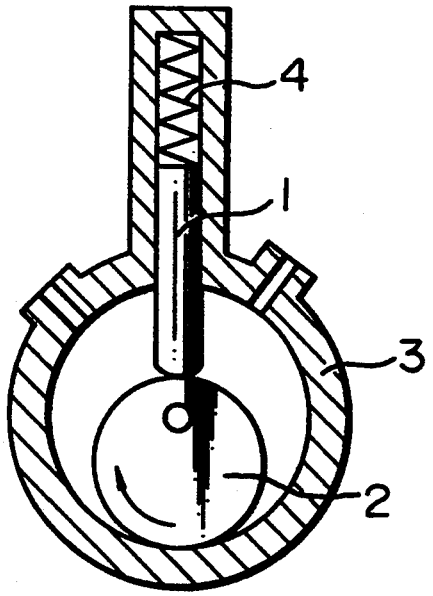
FIG. 1 PRIOR ART
FIG. 1 is a sectional view showing an example of a known rotary compressor.

A description will now be given with respect to the effect of each of the elements in the present invention and the reasons for numerically limiting their respective range.

Carbon is combined with concurrently added W, Mo, V and the like to form hard carbides in the vane material and thus has the advantage of increasing wear resistance of a vane and reducing scatting of the vane due to sliding-contact with the mating member. It also has an advantage of improving wear resistance as it is partly formed into a solid solution in the matrix to increase the hardness of the matrix. Thus, the optimal content of carbon should be determined in relation to the added amount of such carbide-forming elements as W, Mo and V. If carbon is less than 1% in the present invention, a sufficient hardness of the matrix cannot be obtained where the amount of formed carbides is not large. On the other hand, if it exceeds 2.5%, inferior toughness results and hot workability is reduced. Carbon is thus limited to 1.0–2.5%. The most excellent property may be obtained by limiting carbon to 2.0–2.5%.

Silicon has an advantage of improving the steel property as a deoxidation element. It also has an advantage of existing as a solid solution within the matrix to increase the hardness thereof. However, since toughness is reduced if it exceeds 1.5%, Si is limited to not more than 1.5%. The desirable range of Si is 0.1%–0.6%.

Since manganese also has an advantage of improving steel property by acting as a deoxidation element, less than 1.0% of Mn is added. The desirable range of Mn is 0.1–0.6%.

Chromium has an advantage of increasing wear resistance by forming carbides. Further, it exists in the state of a solid solution in the matrix to impart quenching property thereto and to improve the corrosion resistance of the matrix. Particularly, in the present invention, the vane is to be operated under a weak corrosive environment because of the fact that the hygroscopicity of HFC, a substitute freon, is high and that the lubricant oil is decomposed to form such acids as carboxylic acid. It is thus presumed that the unusual wear of a vane is caused not only due to a simple abrasive type wear but also due to a mechanism in which corrosion plays a certain role. In such a case, in addition to Cr, solid solutions of Mo, Co, Ni to be described later in the matrix increases corrosion resistance of a vane and reduces the wear thereof. If chromium is less than 3%, the above described advantage is small in effect, while, on the other hand, hardness is difficult to be obtained through a heat treatment if it exceeds 6%. For these reasons, chromium is limited to 3–6%.

Tungsten and molybdenum are added to improve wear resistance and anti-scuffing property as they form $M_6C$ type carbides upon combining with carbon. After forming a solid solution in the matrix, it is segregated to be hardened through a tempering to increase the hardness of the matrix. Molybdenum also has an advantage of inhibiting corrosion by carboxylic acid. Molybdenum is as twice effective as tungsten. If one or two selected from W and Mo in amount of not more than 20% of W and not more than 12% of Mo are contained at less than 15% in the amount of "W+2Mo", the above described advantage is small in effect. On the other hand, toughness is inferior if 28% is exceeded where hot workability is also reduced. They are limited to 15%–28% in terms of "W+2Mo". The desirable range of "W+2Mo" is 17–26%.

Vanadium and Niobium are the elements which have an important effect in the present invention. That is, V and Nb are combined with carbon to form MC type carbides. By dispersing such carbides finely and uniformly over the vane surface, wear of the vane is reduced and the wear of the mating rotor may also be inhibited. Though its range varies by the structure of the compressor, the material of the mating rotor and required lifetime, 3.5% or more of one or two selected from V and Nb is capable of imparting necessary characteristics to the vane which is to be used with a HFC type substitute freon. Their advantage is remarkable when they are added at 6% or more. If they are less than 3.5%, the above described advantage cannot be sufficiently obtained. On the other hand, if they exceed 10%, it is difficult to be atomized and hot working is difficult. For these reasons, one or two selected from V and Nb is limited to 3.5–10%.

Cobalt and nickel are formed into a solid solution in the matrix, whereby they have the advantage of inhibiting a corrosion by carboxylic acid which is an important aspect of the present invention. That is, if a substitute freon such as of the HFC type is used as the cooling medium, corrosive and abrasion effects are accompanied as described above to cause an extraordinary wear of the vane. Such extraordinary wear may be reduced by causing a total of 1–15% of one or two selected from Co and Ni to form a solid solution in the matrix. Such advantage is apparent particularly when they are contained at 7% or more. However, since toughness is inferior if they exceed 12%, their upper limit is set to 12%. Cobalt also has the effect of inhibiting wear of the vane by increasing the hardness of the matrix and, furthermore, the effect of inhibiting scuffing with the mating rotor is recognized.

A vane serves the function as a compressor while sliding against a rotor and a cylinder. Wear resistance of the vane is improved when a conventionally known high V (vanadium)-type high speed steel or high Co-type high speed steel is used as the vane material. But they are not suitable as-the vane material, because they attack the mating rotor or cylinder to cause an unusual wear thereat due to the fact that the size of carbide grains constituting their microstructure is large. To eliminate this problem, it is found in the present invention that it suffices to fine the diameter of the carbide grains constituting the microstructure to the extent that the mating rotor or cylinder is not attacked. Specifically, it is necessary to have an average carbide grains size of not more than 1.5 μm and to make the diameter of the largest carbide grain to be not more than 6 μm. If this limit is exceeded, the wear of the rotor or cylinder is accelerated to reduce the compression capability though wear of the vane is small.

It is also found that, among the carbides constituting the microstructure of the vane, MC type carbides in particular are capable not only of inhibiting wear of the vane but also of controlling wear of the mating rotor and cylinder. Since such advantage is minimal when the area ratio of the dispersed MC type carbides to the total area is less than 15%, the area ratio of the dispersed MC type carbides is set to 15% or more.

To finely and uniformly disperse the carbides in the vane material, after compacting an atomized powder having the above described composition for example using hot isostatic press, it is subjected to hot working and furthermore to cold working as necessary to produce a flat steel resembling the shape of the cross section of a vane. This will be most suitably made into the vane. According to this method, a vane material having a finer metallic structure comparing to that of one produced by melting and casting may be obtained. Further, such defects as microvoid that are peculiar to sintering do not occur. There is thus an advantage that variance in quality is minimal.

The lifetime of a vane and a rotor is further increased such that a vane produced using the above described vane material is subjected to hardening of the surface such as by nitriding, sulfanitriding and oxynitriding or to processing for increasing the area ratio of the dispersed grains such as of nitrides. Further, the lifetime of a vane and a rotor may be greatly increased also by coating with a film such as of TiN or Ni-P composite layer which is hard and reduces friction.

Some examples will be shown below.

EXPERIMENT 1

Thirteen types of vane materials as shown in Table 1 are prepared. Of these, for A-I and K-M, the materials of the present invention, after canning of gaseous atomized powder, it is compacted by means of hot isostatic pressing and a flat steel is produced through hot forging and hot rolling. For a conventional material J, a conventional high speed tool steel, JIS SKH51, is used of which an ingot produced through melting and molding processes is formed into a flat steel through hot forging and hot rolling in a similar manner as described.

In Table 2, hardness (HRC) after quench- and tempering, the area ratio, average grain size and maximum grain size of the carbides contained in each steel material in that state, wear loss after an wear test, corrosive loss after a corrosion test are respectively shown of the vane materials as shown in Table 1. Note that the wear test is conducted in a manner as follows. Each vane material is formed into a plate shape and JIS FC25 corresponding to a rotor material is formed into a ring. They are slid against each other while dropping an ester type lubricating oil which is reciprocally soluble with HFC134a which is a representative of HFC type freon so as to obtain the wear loss thereof. In Table 2, the respective amounts of wear of plate and ring when using JIS SKH51 as the plate and JIS FC25 as the ring is set to 1.0 and the wear amount of each vane material and corresponding ring is obtained as a relative comparison value for appraisal.

TABLE 1

| Sample | C | Si | Mn | Cr | W | Mo | V | Nb | Co | Ni | Fe | W + 2Mo |
|---|---|---|---|---|---|---|---|---|---|---|---|---|
| A | 1.7 | 0.3 | 0.4 | 3.6 | — | 8.7 | 4.0 | — | 6.5 | — | Bal. | 17.4 |
| B | 1.5 | 0.4 | 0.4 | 4.0 | 16.1 | — | 3.8 | — | 5.3 | — | Bal. | 16.1 |
| C | 1.4 | 0.3 | 0.3 | 4.1 | 8.2 | 6.1 | 4.1 | — | 7.8 | — | Bal. | 20.4 |
| D | 1.6 | 0.3 | 0.3 | 3.8 | 6.4 | 5.3 | 3.2 | 2.2 | 4.9 | — | Bal. | 17.0 |
| E | 1.8 | 0.2 | 0.3 | 5.1 | 4.3 | 8.2 | 5.4 | — | 8.0 | 1.2 | Bal | 20.7 |
| F | 2.2 | 0.4 | 0.5 | 4.6 | 2.6 | 11.2 | 2.7 | 4.6 | 5.1 | 0.8 | Bal. | 25.0 |
| G | 2.0 | 0.2 | 0.3 | 3.5 | 18.1 | 2.1 | — | 6.3 | 11.1 | — | Bal. | 22.3 |
| H | 2.1 | 0.3 | 0.3 | 4.5 | 12.0 | 3.4 | 7.2 | — | 8.3 | — | Bal. | 18.8 |
| I | 2.3 | 0.3 | 0.4 | 4.0 | 9.8 | 8.3 | 3.0 | 4.6 | 10.6 | — | Bal. | 26.4 |
| J | 0.83 | 0.3 | 0.3 | 4.2 | 6.1 | 5.0 | 1.9 | — | — | — | Bal. | 16.1 |
| K | 2.2 | 0.5 | 0.3 | 5.5 | 12.1 | 2.7 | 6.8 | — | — | — | Bal. | 17.5 |
| L | 1.7 | 0.3 | 0.2 | 5.1 | 1.5 | 10.8 | 2.0 | 3.2 | — | — | Bal. | 23.1 |
| M | 2.1 | 0.3 | 0.4 | 3.8 | 18.1 | 2.3 | — | 6.5 | — | 1.3 | Bal. | 22.7 |

*Samples A-I and K-M: Invention material
*Sample J: Conventional material (JIS SKH51)

TABLE 2

| Sample | Hardness (HRC) | Carbide area ratio (%) | | Carbide grain diameter (μ) | | Wear loss | | Corrosion loss ($mg/cm^2 \cdot hr$) |
|---|---|---|---|---|---|---|---|---|
| | | $M_6C$ | MC | Average | Maximum | Vane material | Mating component | |
| A | 67.3 | 10 | 13 | 1.01 | 3.2 | 0.51 | 0.33 | 10 |
| B | 66.4 | 9 | 12 | 1.13 | 2.9 | 0.56 | 0.41 | 12 |
| C | 67.8 | 12 | 13 | 1.08 | 2.8 | 0.56 | 0.38 | 10 |
| D | 66.2 | 9 | 15 | 1.07 | 2.9 | 0.50 | 0.47 | 11 |
| E | 67.5 | 13 | 18 | 1.10 | 3.0 | 0.48 | 0.33 | 8 |
| F | 70.2 | 17 | 18 | 1.14 | 4.6 | 0.41 | 0.30 | 9 |
| G | 67.5 | 15 | 12 | 1.16 | 5.2 | 0.53 | 0.40 | 7 |
| H | 67.3 | 9 | 24 | 1.03 | 3.8 | 0.40 | 0.32 | 9 |
| I | 70.4 | 18 | 20 | 1.13 | 4.0 | 0.44 | 0.28 | 8 |
| J | 65.1 | 10 | 1 | 1.56 | 18.4 | 1.00 | 1.00 | 14 |
| K | 66.0 | 8 | 23 | 1.04 | 4.2 | 0.45 | 0.35 | 12 |
| L | 68.2 | 16 | 16 | 1.15 | 4.8 | 0.50 | 0.41 | 12 |
| M | 67.0 | 15 | 12 | 1.13 | 5.1 | 0.51 | 0.43 | 11 |

EXPERIMENT 2

The materials C, H, K as shown in Table 1 are used to prepare test pieces for an wear test identical to that in Experiment 1. Friction surfaces of some of them are then respectively subjected to nitriding, sulfanitriding and oxynitriding. Further, some other test pieces are subjected to physical vapor deposition to form TiN film thereon, and still some other test pieces are subjected to plating to form a composite plating film of Ni-P-SiC. The obtained test pieces are used to conduct wear test and corrosion test under an identical condition as in Experiment 1. Their result is shown in Table 3.

TABLE 3

| Vane material | Surface treatment | Wear loss | | Corrosion loss ($mg/cm^2 \cdot hr$) |
|---|---|---|---|---|
| | | Vane material | Mating material | |
| C | Nitriding | 0.21 | 0.21 | 10 |
| H | Nitriding | 0.17 | 0.18 | 10 |
| K | Nitriding | 0.18 | 0.21 | 11 |
| H | Sulfa-Nitr. | 0.16 | 0.16 | 10 |
| H | Oxy-Nitr. | 0.16 | 0.18 | 10 |
| C | TiN (PVD) | 0.08 | 0.24 | Nothing |
| H | TiN (PVD) | 0.07 | 0.23 | Nothing |
| K | TiN (PVD) | 0.08 | 0.25 | Nothing |
| H | Ni—P—SiC | 0.19 | 0.59 | Nothing |

According to Table 3, by subjecting the vane materials of the present invention to surface treatment or to hard film coating, it is possible to greatly reduce the wear of vane and the mating component thereof.

EXPERIMENT 3

Vanes are actually produced by using the materials A, H as shown in Table 1 and JIS SKH51 (represented by Sample J) which is a conventional high speed tool steel produced by melting and casting processes. They are incorporated into actual rotary compressors where HFC134a is used as the cooling medium to conduct a lifetime appraisal test.

Note that the appraisal during such test using actual machine is made by estimating the degree of wear or damage of a vane based on Changes in pressure of a pressure gage provided in the rotary compressor.

As a result of the test using actual machine units, the pressure in a test unit using the conventional JIS SKH51 as the vane has changed suddenly 125 hours after the start of operation. Thus operation is stopped to observe the state of the vane. A partial galling is seen on the surface of the vane made of JIS SKH51 which slides against a rotor and a scratch due to galling is observed also on the peripheral surface of the mating rotor. On the other hand, change in the pressure of the rotary compressors using vanes made of the materials A and B of the present invention is not recognized after 720 hours of operation at which the test is terminated.

According to the present invention, the wear resistance of a vane in a compressor using a substitute freon represented by a HFC type, freon is greatly improved. Such wear resistance has not been sufficient with the class of JIS SKH51 which is a conventional vane material. A vane of the present invention contains finely and uniformly dispersed carbides and has an increased area ratio of dispersed MC type carbides. It is greatly effective in preventing the wear and scuffing of rotor and cylinder which are the mating member thereof. A high corrosive resistance is also exhibited against such acids as carboxylic acid which is formed by the decomposition of the lubricating oil in a compressor using a HFC type freon. Further, a compressor having a long lifetime may be obtained by providing a surface hardening layer or hard coating film at least on the sliding surface of the vane. Thus, with a vane of the present invention, a compressor satisfying the environmental restrictions may be achieved, since it is able to respond to new types of cooling mediums on the basis of its high wear resistance and high corrosion resistance.

What is claimed is:

1. A vane material being made from a powder by compacting the powder at hot working temperature thereof and having substantially no void, and having a hardness of HRC 65.1 to 70.4, comprising a composition containing by weight: 1.0–2.5% of C, not more than 1.5% of Si, not more than 1.0% of Mn, 3–6% of Cr, at least one selected from W and Mo in an amount of not more than 20% of W and not more than 12% of Mo, "W+2Mo" being 15–28%, 3.5–10% of at least one selected from V and Nb, and the balance of Fe and incidental impurities; wherein carbides are uniformly dispersed in the composition, the average grain size of said carbides being not more than 1.5 μm, the largest grain diameter of said carbides being not more than 6 μm.

2. A vane material being made from a powder by compacting the powder at hot working temperature thereof and having substantially no void, and having a hardness of HRC 65.1 to 70.4, comprising a composition containing by weight: 1.0–2.5% of C, not more than 1.5% of Si, not more than 1.0% of Mn, 3–6% of Cr, at least one selected from W and Mo in an amount of not more than 20% of W and not more than 12% of Mo, "W+2Mo" being 15–28%, 3.5–10% of at least one selected from V and Nb, 1–15% of at least one selected from Co and Ni, and the balance of Fe and incidental impurities; wherein carbides are uniformly dispersed in the composition, the average grain size of said carbides being not more than 1.5 μm, the largest grain diameter of said carbides being not more than 6 μm.

3. A vane material having substantially no void, comprising a composition containing by weight: 2.0–2.5% of C, 0.1–0.6% of Si, 0.1–0.6% of Mn, 3–6% Cr, at least one selected from W and Mo in an amount of not more than 20% of W and not more than 12% of Mo, "W+2Mo" being 17–26%; 6–10% of at least one selected from V and Nb, 7–12% of at least one selected from Co and Ni, and the balance of Fe and incidental impurities; wherein carbides are uniformly dispersed in the composition, the average grain size of said carbides being not more than 1.5 μm, the largest grain diameter of said carbides being not more than 6 μm.

4. A vane material according to any one of claims 1 to 3, wherein the area of MC type carbides dispersed in the composition is not less than 15% of the total area, wherein M is a metal element and C is carbon.

5. A vane material having substantially no void, comprising a composition containing by weight: 1.0–2.5% of C, not more than 1.5% of Si, not more than 1.0% of Mn, 3–6% of Cr, at least one selected from W and Mo in an amount of not more than 20% of W and not more than 12% of Mo, "W+2Mo" being 15–28%, 3.5–10% of at least one selected from V and Nb, and the balance of Fe and incidental impurities; wherein carbides are uniformly dispersed in the composition, the average grain size of said carbides being not more than 1.5 μm, the largest grain diameter of said carbides being not more than 6 μm; and a hardened layer on a sliding surface of said vane.

6. A vane material having substantially no void, comprising a composition containing by weight: 1.0–2.5% of C, not more than 1.5% of Si, not more than 1.0% of Mn, 3–6% of Cr, at least one selected from W and Mo in an amount of not more than 20% of W and not more than 12% of Mo, "W+2Mo" being 15–28%, 3.5–10% of at least one selected from V and Nb, 1–15% of at least one selected from Co and Ni, and the balance of Fe and incidental impurities; wherein carbides are uniformly dispersed in the composition, the average grain size of said carbides being not more than 1.5 μm, the largest grain diameter of said carbides being not more than 6 μm; and a hard coating layer on a sliding surface of said vane.

7. A method of producing a vane having substantially no void, comprising the steps of:

compacting an atomized powder having a composition containing by weight: 1.0–2.5% of C, not more than 1.5% of Si, not more than 1.0% of Mn, 3–6% of Cr, at least one selected from W and Mo in an amount of not more than 20% of W and not more than 12%. of Mo, "W+2Mo" being 15–28%, 3.5–10% of at least one selected from V and Nb, and the balance of Fe and incidental impurities; wherein carbides are uniformly dispersed in the composition., the average grain size of said carbides being not more that 1.5 μm, the largest grain diameter of said carbides being not more than 6 μm; and subjecting the resulting compact to one of hot working and to hot working and cold working.

8. A vane material according to any one of claims 1 to 3, wherein the area of MC type carbides dispersed in the composition is not less than 15% of the total area, wherein M is a metal element and C is carbon, and further comprising: a hardened layer on a sliding surface of said vane.

9. A vane material according to any one of claims 1 to 3, wherein the area of MC type carbides dispersed in the composition is not less than 15% of the total area, wherein M is a metal element and C is carbon, and further comprising: a hard coating layer on a sliding surface of said vane.

10. A vane for use in a rotary device comprising a material having substantially no void and having a hardness of HRC 65.1 to 70.4, said material formed from a composition having, by weight: 1.0–2.5% of C, not more than 1.5% of Si, not more than 1.0% of Mn, 3–6% of Cr, at least one selected from W and Mo in an amount of not more than 20% of W and not more than 12% of Mo, where "W+2Mo" is limited to 15–28%, 3.5–10% of at least one selected from V and Nb, and the balance being Fe and incidental impurities; wherein carbides are uniformly dispersed in the composition, the average grain size of said carbides being not more than 1.5 μm and the largest grain size being not more than 6 μm.

11. A vane for use in a rotary device comprising a material having substantially no void and having a hardness of HRC 65.1 to 70.4, said material formed from a composition having, by weight: 1.0–2.5% of C, not more than 1.5% of Si, not more than 1.0% of Mn, 3–6% of Cr, at least one selected from W and Mo in an amount of not more than 20% of W and not more than 12% of Mo, where "W+2Mo" is limited to 15–28%, 3.5–10% of at least one selected from V and Nb, 1–15% of at least one selected from Co and Ni, the balance being Fe and incidental impurities; wherein carbides are uniformly dispersed in the composition, the average grain size of said carbides being not more than 1.5 μm and the largest grain size being not more than 6 μm.

12. A vane for use in a rotary device comprising a material, said material formed from a composition having, by weight: 2.0–2.5% of C, 0.1–0.6% of Si, 0.1–0.6% of Mn, 3–6% of Cr, at least one selected from W and Mo in an amount of not more than 20% of W and not more than 12% of Mo, where "W+2Mo" is limited to 17–26%; 6–10% of at least one selected from V and Nb, 7–12% of at least one selected from Co and Ni, and the balance being Fe and incidental impurities; wherein carbides are uniformly dispersed in the composition, the average grain size of said carbides being not more than 1.5 μm and the largest grain size being not more than 6 μm.

13. A vane for use in a rotary device according to any one of claims 10 to 12, wherein said carbides are MC type carbides, where M is a metal element and C is Carbon, and the area of MC type carbides dispersed in said composition is not less than 15% of the total area.

* * * * *